US007712734B2

(12) United States Patent
Kang

(10) Patent No.: US 7,712,734 B2
(45) Date of Patent: May 11, 2010

(54) MULTI-PURPOSE FEEDER FOR OFFICE AUTOMATION MACHINERY

(75) Inventor: Il-kwon Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 973 days.

(21) Appl. No.: 11/324,263

(22) Filed: Jan. 4, 2006

(65) Prior Publication Data

US 2006/0291342 A1 Dec. 28, 2006

(30) Foreign Application Priority Data

Jun. 27, 2005 (KR) ..... 10-2005-0055548

(51) Int. Cl.
*B65H 3/44* (2006.01)

(52) U.S. Cl. ..... 271/9.01; 271/162

(58) Field of Classification Search ..... 271/8.1, 271/9.01, 9.08, 9.11, 145, 162, 163, 207; 399/391, 392, 393, 405
See application file for complete search history.

(56) References Cited

U.S. PATENT DOCUMENTS

| | | | | |
|---|---|---|---|---|
| 4,671,503 | A * | 6/1987 | Uemori | 271/65 |
| 5,082,269 | A * | 1/1992 | Hirayama et al. | 271/65 |
| 5,317,365 | A * | 5/1994 | Tschiderer et al. | 355/75 |
| 5,984,300 | A | 11/1999 | Nishiberi | 271/171 |
| 2003/0052956 | A1 * | 3/2003 | Katsuyama | 347/108 |
| 2005/0116406 | A1 * | 6/2005 | Cheng | 271/3.14 |

FOREIGN PATENT DOCUMENTS

| | | | |
|---|---|---|---|
| JP | 02-013542 | | 1/1990 |
| JP | 2-70640 | * | 3/1990 |
| JP | 8-104449 | * | 4/1996 |
| JP | 9-30659 | * | 2/1997 |
| JP | 9-110271 | * | 4/1997 |
| JP | 10-231050 | * | 9/1998 |
| JP | 11-180602 | * | 7/1999 |
| JP | 2001-163454 | | 6/2001 |
| JP | 2002-193496 | | 7/2002 |
| JP | 2004-323172 | | 11/2004 |
| JP | 2005-341393 | * | 12/2005 |

* cited by examiner

*Primary Examiner*—Patrick H Mackey
*Assistant Examiner*—Thomas A Morrison
(74) *Attorney, Agent, or Firm*—Roylance, Abrams, Berdo & Goodman, L.L.P.

(57) ABSTRACT

A multi-purpose feeder (MPF) for office automation (OA) machinery includes an MPF tray installed rotatably on a main body panel so that it can be opened and closed. An auxiliary stocker is rotatably installed on the tray by a hinge. An auxiliary stocker pivoting unit automatically pivots the auxiliary stocker as the MPF tray is opened and closed. Since the auxiliary stocker is automatically opened and folded when the MPF tray is opened and closed with respect to the main body, the MPF has improved user's convenience.

12 Claims, 4 Drawing Sheets

MULTI-PURPOSE FEEDER FOR OFFICE AUTOMATION MACHINERY

CROSS-REFERENCE TO RELATED APPLICATIONS

This application claims the benefit under 35 U.S.C. §119(a) of Korean Patent Application No. 2005-55548, filed on Jun. 27, 2005, the entire content of which is hereby incorporated by reference.

BACKGROUND OF THE INVENTION

1. Field of the Invention

The present invention generally relates to office automation (OA) machinery such as copiers, printers, fax machines, and the like. More specifically, the present invention relates to a multi-purpose feeder for office automation machinery.

2. Description of the Related Art

In general, OA machinery such as copiers, printers, fax machines, and the like, have a multi-purpose feeder (MPF) that holds several sizes and types of print papers.

FIG. 1A and FIG. 1B are perspective views illustrating the configuration and operation of a conventional MPF, respectively.

As shown in FIGS. 1A and 1B, a conventional MPF includes an MPF tray 10 rotatably installed on a main body panel 1 so that it can be opened to a predetermined angle. An auxiliary stocker 20 is rotatably installed on a front end portion of the tray 10.

Moreover, guide units 11 are installed on both sides of the tray 10 to guide different sizes of paper in a horizontal direction.

An MPF with the above configuration is not used for a cassette feed operation of a printer. Therefore, if a user wants to use the MPF, the user first needs to rotate the tray 10 to a certain angle by using a handle 10*a* of the tray 10 to open the MPF. Then, the user needs to rotate the auxiliary stocker 20 housed inside the MPF to fully open the tray, and load paper in the tray to begin the printing operation.

In other words, in a conventional MPF, a user has to first open the tray and then open the auxiliary stocker, which is not convenient, especially when the user is in hurry.

Moreover, after using the MPF, the user has to return the auxiliary stocker back to its original, closed position. If the auxiliary stocker is not properly closed, the tray will not completely close.

Accordingly, there is a need for an improved multi-purpose feeder for office automation machinery that has a more convenient MPF tray with an auxiliary stocker.

SUMMARY OF THE INVENTION

An aspect of the present invention is to address at least the above problems and/or disadvantages and to provide at least the advantages described below. Accordingly, an aspect of the present invention is to provide a multi-purpose feeder for office automation machinery that can be more conveniently used, in that an auxiliary stocker is built to automatically rotate the auxiliary stocker as the MPF tray is opened and closed.

In accordance with an aspect of the invention, a multi-purpose feeder (MPF) for office automation (OA) machinery is provided. The MPF includes an MPF tray rotatably installed rotatably on a main body panel so that it can be opened and closed. An auxiliary stocker is rotatably installed on the tray by pivots. An auxiliary stocker pivoting unit automatically pivots the auxiliary stocker when the tray is opened and closed.

In an exemplary embodiment, the auxiliary stocker pivoting unit may include a pivoting link connected to the auxiliary stocker, and the pivoting link may have a hinge. A first end of a coupling link having a first end and a second end is hinged to the hinge of the pivoting link. A first end of a link arm having a first end and a second end is connected to the second end of the coupling link and the second end of the link arm is hinged to the main body panel.

In an exemplary embodiment, a first elongated hole with a predetermined length may be formed on the other end of the coupling link, so as to enable the auxiliary stocker to rotate after the tray rotates further than a predetermined rotation angle.

Moreover, a second elongated hole having a predetermined length may be formed on the side of the MPF tray. The second elongated hole is connected to the link arm to control a rotation angle of the tray.

The MPF may further include a restoring unit for providing a restoring force to bias the auxiliary stocker in a closed direction.

The restoring unit may be formed of a torsion spring disposed on the pivot of the auxiliary stocker. A first end of the restoring unit may be supported by the tray and a second end of the restoring unit may be supported by the auxiliary stocker.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1A:
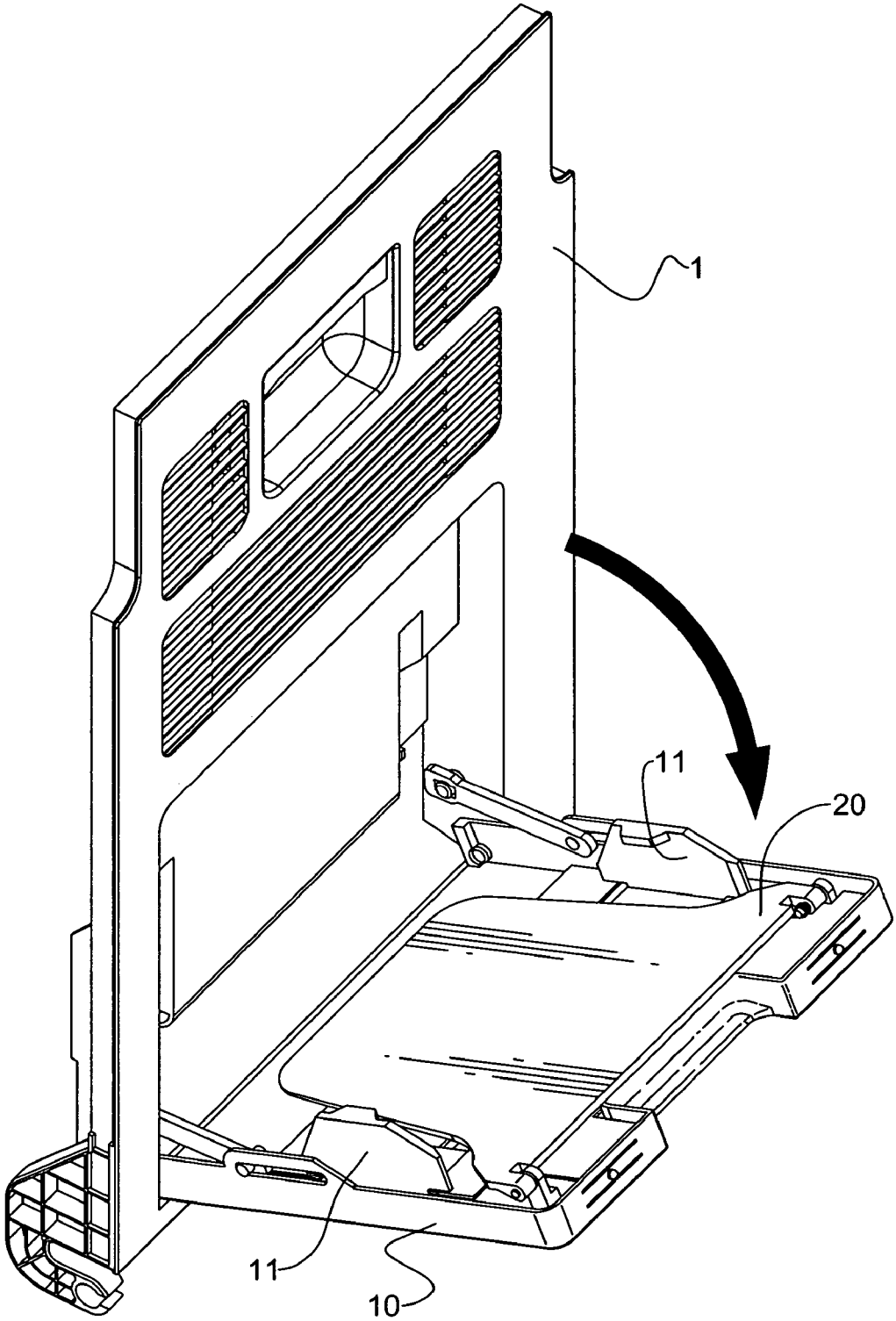
FIG. 1A (PRIOR ART)
FIGS. 1A and 1B are perspective views illustrating the configuration and operation of a conventional MPF, respectively.
Figure 1B:
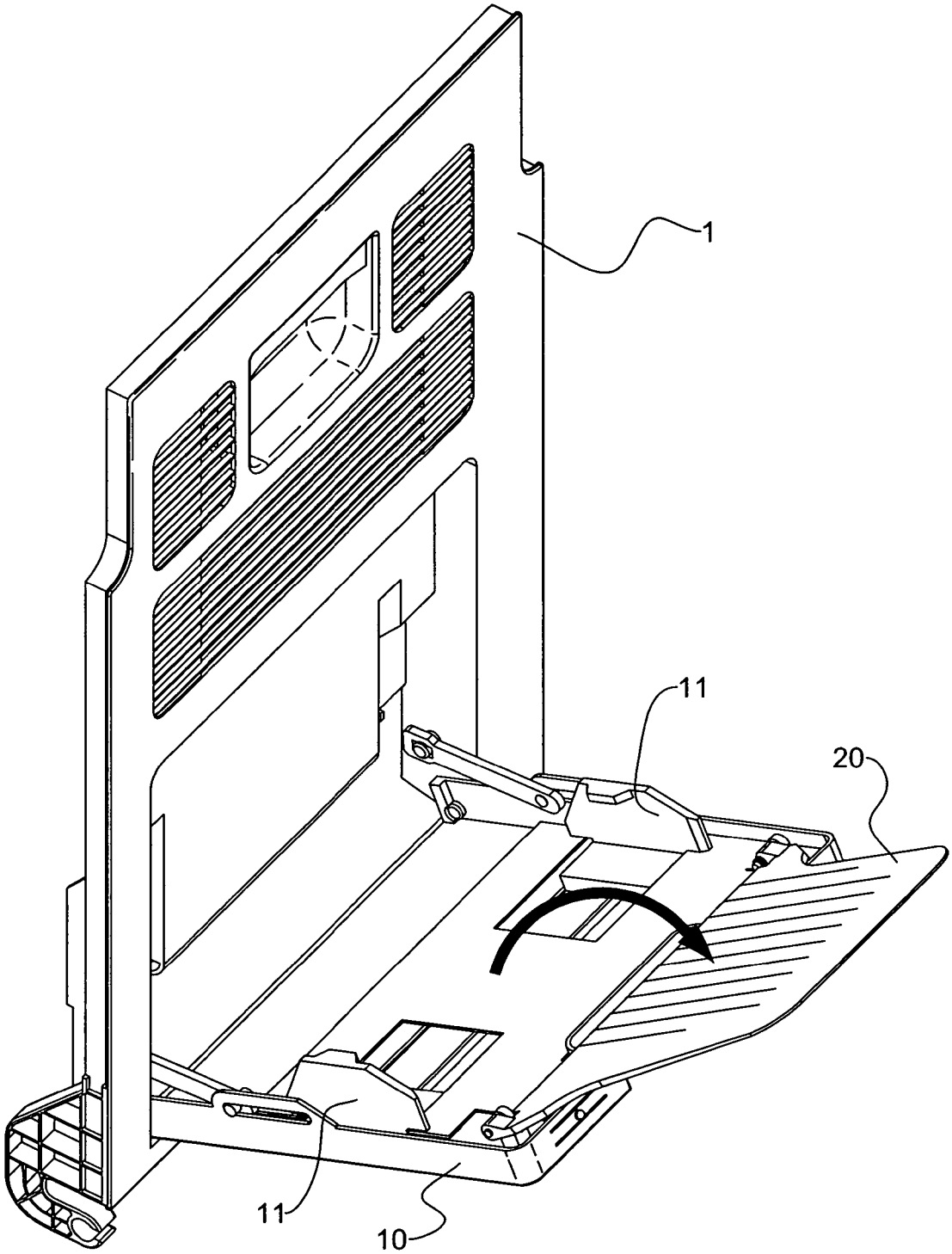
FIG. 1B (PRIOR ART)
Figure 2:
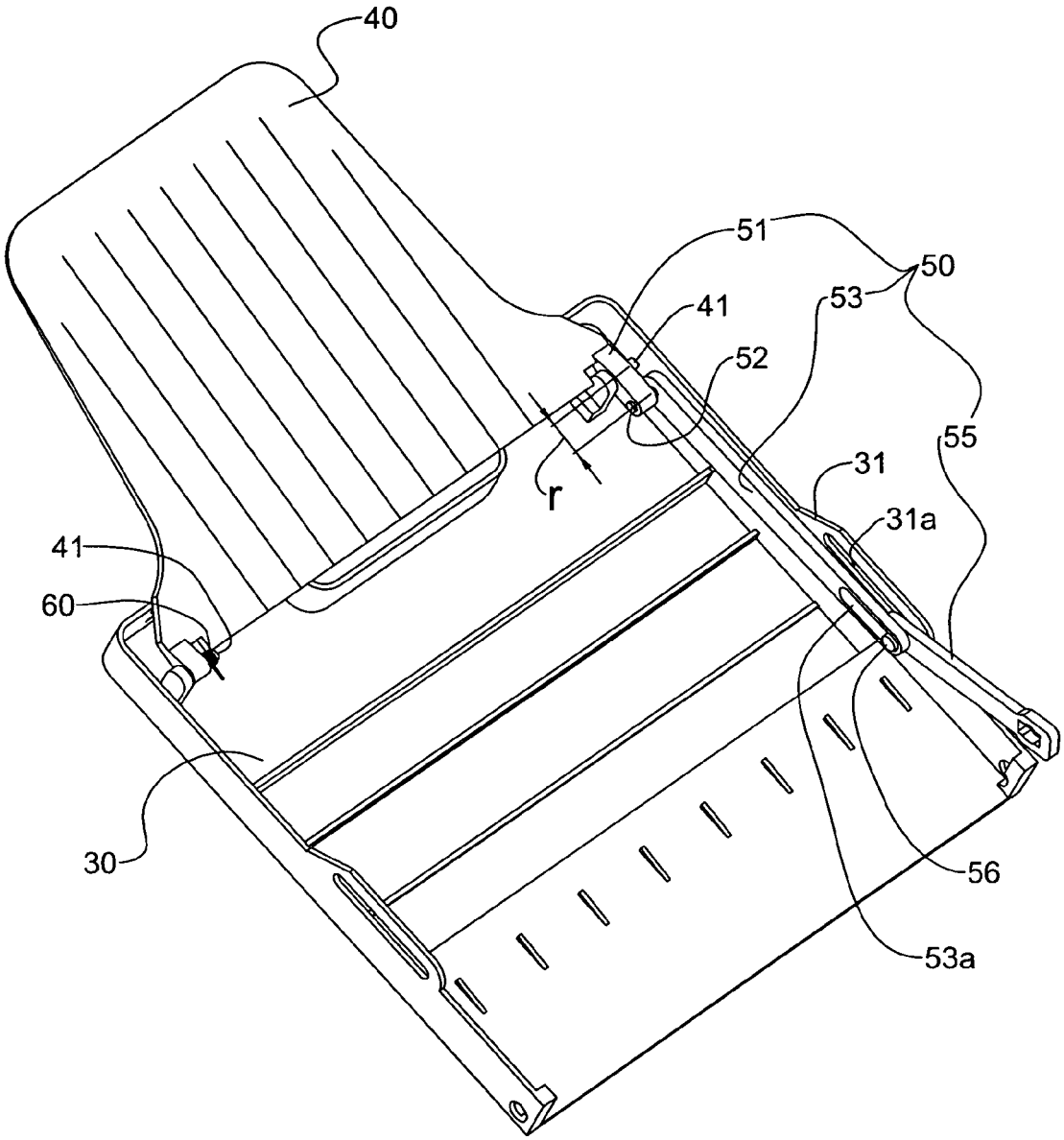
FIG. 2 is a perspective view of a multi-purpose feeder for office automation (OA) machinery, in accordance with an exemplary embodiment of the present invention.

FIG. 2 is a perspective view of a multi-purpose feeder (MPF) (or multi-purpose paper input) for office automation (OA) machinery, in accordance with an exemplary embodiment of the present invention.

As shown in FIG. 2, the MPF of the exemplary embodiment of the present invention includes an MPF tray 30, an auxiliary stocker 40, and an auxiliary stocker pivoting unit 50.

The MPF tray 30 is installed rotatably on a main body panel so that it can be opened to a predetermined angle. Guide units (not shown) for guiding papers are installed on both sides of the MPF tray 30.

The auxiliary stoker 40 is installed on a front end of the tray 30 by pivots 41 so that it can be opened and closed. The auxiliary stocker 40 may be opened so that, for example, a large sheet of paper can be stably mounted on the stocker.

The auxiliary stocker pivoting unit 50 allows the auxiliary stocker 40 to be automatically opened and closed by opening and closing the tray 30.

The auxiliary stocker pivoting unit 50 includes a pivoting link 51, a coupling link 53, and a link arm 55.

The pivoting link 51 is rotatably connected to one side of a pivot 41 of the auxiliary stocker 40. A portion of the pivoting link 51 located away from the pivot 41 is connected to one end of the coupling link 53 by a hinge 52.

Since the pivot 41 of the auxiliary stocker 40 is hinged to both sides of the front end portion of the tray 30, respectively, the auxiliary stocker 40 is able to pivot with respect to the tray 30.

A first end of the coupling link 53 is connected to one side of the pivoting link 51 by the hinge 52. The other (second) end of the coupling link 53 has a first elongated hole 53*a* of a predetermined length formed therein, into which a sliding protrusion 56 of the link arm 55 is inserted.

The first elongated hole 53*a* is formed in a lateral direction of the other end of the coupling link 53. The hinge 52 has a radius of rotation (r) with respect to the pivot 41 connecting the coupling link 53 to the pivoting link 51. Preferably, the first elongated hole 53*a* is at least twice as long as the radius of rotation (r).

At one end (a first end) on one side of the link arm 55 there is the sliding protrusion 56, which is inserted into the first elongated hole 53*a* formed in the coupling link 53 and slides inside along the hole. The other (second) end of the link arm 55 is connected to the main body panel by a hinge 58.

In addition, at one end of the other side of the link arm 55 there is a suspending projection (not shown) for controlling the opening angle of the tray. This suspending projection is inserted into a second elongated hole 31*a* formed in a side frame 31, and slides inside along the hole.

In this manner, when opened, the tray 30 maintains its open state at a predetermined angle with respect to the side of the main body panel.

The MPF further includes a restoring unit for additional convenience. When a user closes the MPF tray 30 towards the main body after using the MPF, the restoring unit provides a restoring force in the closing direction to the auxiliary stocker 40 so that the auxiliary stocker 40 may easily return to its original position.

The restoring unit is preferably a torsion spring 60 disposed on the pivot of the auxiliary stocker 40. Preferably, the torsion spring is disposed on the end of the pivot 41 which is not connected to the pivoting link 51. A first end of the torsion spring 60 is supported by the tray 30 and a second end of the torsion spring 60 is supported by the auxiliary stocker 40.

The operation of the exemplary embodiment of the MPF for OA machinery according to the present invention will now be described.

Figure 3:
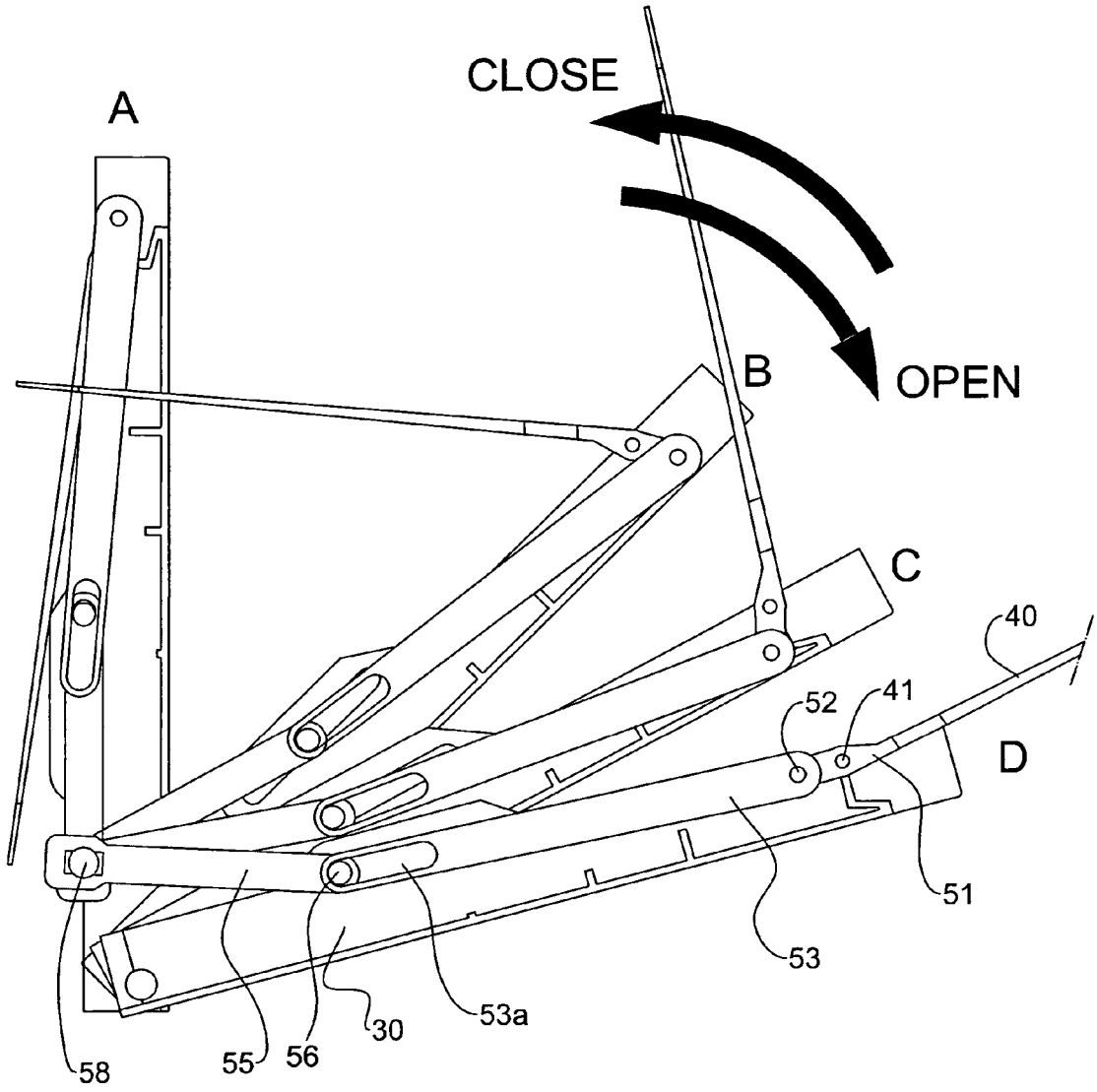
FIG. 3 diagrammatically illustrates the operation of a multi-purpose feeder for OA machinery, in accordance with an exemplary embodiment of the present invention.

FIG. 3 is a state diagram illustrating an opening and closing operation of the MPF of OA machinery of the present invention. As depicted in the drawing, when the MPF tray 30 is opened, the tray moves from its substantially closed position A to a partially open position B. During this movement, the auxiliary stocker 40 begins to open when the tray 30 approaches the B position.

When the tray 30 rotates further than a predetermined rotation angle down to the B position, the sliding protrusion 56 is suspended on the inner surface of the first elongated hole 53*a* formed in the coupling link 53.

As the tray 30 moves further down to a C position and a D position, the pivoting link 51 connected to one end of the coupling link 53 by the hinge 52 is pivoted in the pull-out direction. As a result, the auxiliary stocker 40 connected to the pivoting link 51 pivots with respect to the pivot 41 in the OPEN direction.

Therefore, as the user opens the MPF tray 30, the rotation of the MPF tray 30 continues until the suspending projection formed in the link arm 55 for use in the opening angle control is locked (or suspended) onto the inner surface of the second elongated hole 31 formed in the side frame 31 of the tray 30.

Once the tray 30 stops rotating, the rotation of the auxiliary stocker 40 is also stopped by the interaction among the link arm 55, the coupling link 53, and the pivoting link 51.

Meanwhile, as the user rotates the tray 30 in the CLOSE direction after using the MPF, the interaction among the link arm 55, the coupling link 53, and the pivoting link 51 is loosened.

Therefore, when an external force on the auxiliary stocker 40 disappears, the auxiliary stocker 40 is folded by the restoring force of the torsion spring 60 installed at the pivot of the auxiliary stocker 40 while making a relative rotation to the tray 30, and eventually returns to its original position, that is, to the inside of the main body.

As explained so far, the exemplary embodiment of an MPF for OA machinery of the present invention has improved convenience for a user by making the auxiliary stocker, which is rotatably installed on the front end of the MPF tray so that it can be opened, be automatically opened and folded with the opening and closing operation of the MPF tray with respect to the main body.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A multi-purpose paper input for office automation machinery, comprising:

a multi-purpose feeder tray installed rotatably on a main body panel to move between an opened position and a closed position;

an auxiliary stocker rotatably installed directly on the tray by a pivot;

an auxiliary stocker pivoting unit connected to the tray and the auxiliary stocker, such that the auxiliary stocker pivoting unit automatically pivots the auxiliary stocker relative to the tray when the tray is opened and closed; and a restoring unit disposed on the pivot of the auxiliary stocker for providing a restoring force to bias the auxiliary stocker in a closed direction wherein the restoring unit is a torsion spring.

2. The multi-purpose paper input according to claim 1, wherein the auxiliary stocker pivoting unit comprises:

a pivoting link rotatably disposed on the pivot of the auxiliary stocker, the pivoting link having a hinge;

a coupling link with a first end and a second end, the first end of the coupling link being hinged to the hinge of the pivoting link; and a link arm having a first end and a second end, the first end of the link arm being connected to the second end of the coupling link and the second end of the link arm being hinged to the main body panel.

3. The multi-purpose paper input according to claim 2, wherein a first elongated hole with a predetermined length is formed on the second end of the coupling link, so as to enable the auxiliary stocker to rotate after the tray rotates further than a predetermined rotation angle.

4. The multi-purpose paper input according to claim 3, wherein a second elongated hole having a predetermined length is formed on the multi-purpose feeder tray and is connected to the link arm, so as to control a rotation angle of the tray.

5. The multi-purpose paper input according to claim 1, wherein a first end of the torsion spring is supported by the tray and a second end of the torsion spring is supported by the auxiliary stocker.

6. The multi-purpose paper input according to claim 3, wherein the predetermined length of the first elongated hole is at least twice a distance (r) between the pivot of the auxiliary stocker and the hinge of the pivoting link.

7. A multi-purpose paper input for an office machine, comprising:

a multi-purpose feeder tray pivotably installed on the office machine to move between an opened position and a closed position;

an auxiliary stocker pivotably installed on the multi-purpose feeder tray to move between an opened position and a closed position, the auxiliary stocker having a pivoting link;

a coupling link with a first end and a second end, the first end of the coupling link being hinged to the pivoting link;

a link arm having a first end and a second end, the first end of the link arm being connected to the second end of the coupling link and the second end of the link arm being hinged to the main body panel; and a pivot, wherein the auxiliary stocker is pivotably installed on the multi-purpose feeder tray by the pivot;

a restoring unit for providing a restoring force to bias the auxiliary stocker in a closed direction, the restoring unit being disposed on the pivot of the auxiliary stocker, wherein the restoring unit is formed of a torsion spring.

8. The multi-purpose paper input according to claim 7, wherein a first elongated hole with a predetermined length is formed on the second end of the coupling link, so as to enable the auxiliary stocker to rotate after the tray rotates further than a predetermined rotation angle.

9. The multi-purpose paper input according to claim 8, wherein a second elongated hole having a predetermined length is formed on the multi-purpose feeder tray and is connected to the link arm, so as to control a rotation angle of the tray.

10. The multi-purpose paper input according to claim 7, wherein a first end of the torsion spring is supported by the tray and a second end of the torsion spring is supported by the auxiliary stocker.

11. The multi-purpose paper input according to claim 8, wherein:

the pivoting link has a hinge, and the first end of the coupling link is connected to the hinge of the pivoting link.

12. The multi-purpose paper input according to claim 11, wherein a length of the first elongated hole is at least twice a distance (r) between the pivot and the hinge of the pivoting link.

* * * * *